US010217575B2

(12) United States Patent
Motoi

(10) Patent No.: US 10,217,575 B2
(45) Date of Patent: Feb. 26, 2019

(54) SWITCH DEVICE

(71) Applicant: ALPS ELECTRIC CO., LTD., Ota-ku, Tokyo (JP)

(72) Inventor: Hiromi Motoi, Tokyo (JP)

(73) Assignee: ALPS ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 15/441,304

(22) Filed: Feb. 24, 2017

(65) Prior Publication Data

US 2017/0243703 A1 Aug. 24, 2017

(30) Foreign Application Priority Data

Feb. 24, 2016 (JP) ..... 2016-033667

(51) Int. Cl.

| | |
|---|---|
| ***H01H 9/00*** | (2006.01) |
| ***H01H 13/02*** | (2006.01) |
| ***H01H 13/14*** | (2006.01) |
| ***H01H 13/83*** | (2006.01) |

(52) U.S. Cl.

CPC ..... *H01H 13/023* (2013.01); *H01H 13/14* (2013.01); *H01H 13/83* (2013.01); *H01H 2217/004* (2013.01); *H01H 2219/06* (2013.01); *H01H 2221/058* (2013.01)

(58) Field of Classification Search

CPC ..... H01H 13/023; H01H 13/14; H01H 1/00; H01H 9/00; H01H 13/70; H01H 13/702; H01H 13/703; H01H 13/704; H01H 2239/074; H01H 2203/008; H01H 2207/01; H01H 2221/00; H01H 2231/002; H01H 2231/012; H01H 2231/016; H01H 2231/052; H01H 2239/006; H01H 13/00; H01H 13/83; H01H 2217/004; H01H 2219/06; H01H 2221/058

USPC ..... 200/314

See application file for complete search history.

(56) References Cited

U.S. PATENT DOCUMENTS

| | | | | |
|---|---|---|---|---|
| 4,710,602 | A * | 12/1987 | Baity | H01H 13/705 200/315 |
| 7,411,142 | B2 * | 8/2008 | Jung | H01H 13/83 200/314 |
| 2005/0006215 | A1 | 1/2005 | Sasaki et al. | |
| 2009/0231857 | A1 * | 9/2009 | Ito | H01H 13/83 362/311.14 |

* cited by examiner

*Primary Examiner* — Anthony R. Jimenez

(74) *Attorney, Agent, or Firm* — Hunton Andrews Kurth LLP

(57) ABSTRACT

A switch device includes a base part which includes a switch element, an operating member, a force transmission member which transmits a force between the switch element and the operating member, a light source, and a reflective surface. The operating member includes an operating outer surface, an operating inner surface, and a transmitting member. The transmitting member has a transmitting inner surface. At least a portion of the force transmission member is disposed along a pressing direction between the transmitting inner surface and the switch element. The reflective surface is disposed at a position where it reflects at least a part of the light from the light source to at least a portion of the transmitting inner surface.

12 Claims, 11 Drawing Sheets

SWITCH DEVICE

CLAIM OF PRIORITY

This application contains subject matter related to and claims the benefit of Japanese Patent Application No. 2016-033667 filed on Feb. 24, 2016, the entire contents of which is incorporated herein by reference.

BACKGROUND OF THE DISCLOSURE

1. Field of the Disclosure

Embodiments of the present disclosure relate to a switch device.

2. Description of the Related Art

In the related art, like a switch device of Japanese Unexamined Patent Application Publication No. 2003-272473, a structure in which a push button switch for pressing a switch element disposed over a substrate toward the substrate is supported by an elastic member is known. FIG. 10 is a cross-sectional view of a push button switch 900 of Japanese Unexamined Patent Application Publication No. 2003-272473. As shown in FIG. 10, in the push button switch 900, a push button part 902 moves up and down with respect to a case 901. A light guide plate 903 for transmitting the light from diode to an internal space is disposed at the center of the inside of the case 901. The light which is radiated from the light guide plate 903 widely irradiates the push button part 902. FIG. 11 is a partial side view of the push button switch 900 of Japanese Unexamined Patent Application Publication No. 2003-272473. A lever member 904 of FIG. 11 elastically supports the push button part 902 with respect to the case 901 (FIG. 10). The lever member 904 is connected to the push button part 902 in the vicinity of the periphery of the push button switch 900. The lever member 904 is connected to the case 901 (FIG. 10) in the vicinity of the center. If the push button part 902 is pushed, the lever member 904 is elastically deformed, whereby a switch actuating member 905 fixed to the push button part 902 pushes a built-in switch 906 fixed to the case 901 (FIG. 10). In the push button switch 900 of Japanese Unexamined Patent Application Publication No. 2003-272473, the push button part 902 is supported at the periphery, and therefore, a space for disposing the light guide plate 903 functioning as a light source for decoration is present inside of the push button switch 900.

However, the light source for decoration cannot be necessarily freely disposed. For example, the push button switch 900 is provided with the structure of supporting the push button part 902 with an elastic member in the vicinity of the periphery of the push button switch 900, and the space for disposing the light source in the vicinity of the center of the push button switch 900. However, in such a configuration, the push button part 902 does not necessarily move straight in a pressing direction, and therefore, there is a disadvantage that the push button part 902 lacks the reliability of an operation of pushing the built-in switch 906 and an operation feeling is bad. On the other hand, if, in order to enhance the reliability of the operation, the elastic member is disposed in the vicinity of the center of gravity of the push button part 902 when the push button switch 900 is viewed in the pressing direction from above, the light source has to be disposed at a location away from the center of gravity. In such a case, there is a disadvantage that due to light shielding by the elastic member, a difference in distance from the light source to an irradiation target portion, or the like, irradiation unevenness occurs and optical decorativeness is impaired.

These and other drawbacks exist.

SUMMARY OF THE DISCLOSURE

The present disclosure provides a switch device in which it is possible to efficiently transmit light from a light source to an irradiation target portion to enhance optical decorativeness.

According to an example embodiment, a switch device includes a base part which includes a switch element switchable between a pressed state and a released state; an operating member which is disposed so as to be movable between a pressing position causing the pressed state of the switch element and a release position causing the released state of the switch element, in a pressing direction toward the pressing position from the release position and a release direction toward the release position from the pressing position; a force transmission member which is disposed so as to be movable in the pressing direction and the release direction between the switch element and the operating member in an internal space defined between the base part and the operating member and transmits a force between the switch element and the operating member; a light source configured to radiate light to the internal space; and a reflective surface, in which the operating member includes an operating outer surface configured to receive an operating force in the pressing direction from the outside, an operating inner surface configured to be irradiated with light from the light source in the internal space, and a transmitting member configured to transmit light between the operating outer surface and the operating inner surface, the transmitting member has a transmitting inner surface which faces the internal space in the pressing direction, at least a portion of the force transmission member is disposed along the pressing direction between the transmitting inner surface and the switch element, and the reflective surface is disposed at a position where the reflective surface reflects at least a part of the light from the light source to at least a portion of the transmitting inner surface.

According to this example, due to the existence of the reflective surface, even if the light source and the transmitting member are not disposed to overlap each other in the pressing direction, the transmitting member is efficiently illuminated with the light from the light source. Therefore, even in a case where a restriction is imposed on the position from the light source, the optical decorativeness of the switch device can be enhanced. Furthermore, the degree of freedom of design increases.

Also, in a switch device according to the an example embodiment, the reflective surface is inclined from the release direction so as to face the transmitting inner surface in the release direction, and at least a portion of the reflective surface is disposed so as to overlap the transmitting inner surface in the release direction.

According to this example, since the reflective surface is inclined from the release direction so as to face the transmitting inner surface in the release direction and at least a portion of the reflective surface is disposed so as to overlap the transmitting inner surface in the release direction, the transmitting inner surface is easily irradiated with the light from the light source.

Additionally, in a switch device according to an example embodiment, the force transmission member includes the reflective surface.

According to this example, the force transmission member includes the reflective surface, and therefore, light is efficiently transmitted even to a location where light may not easily reach due to light being blocked by the force transmission member, if there is no reflective surface. Therefore, the transmitting member can be irradiated with the light. Furthermore, a configuration is made such that the force transmission member can be disposed in the vicinity of the center of gravity of the switch device when viewed in a planar view, and therefore, it becomes easy to enhance the reliability of a switch operation of the switch device.

Further, in a switch device according to an example embodiment, the operating member includes an operation-side contact portion which comes into contact with the force transmission member, the force transmission member includes a light guiding part and a support post which moves integrally with each other, the light guiding part has the reflective surface, the support post has a transmission-side contact portion, and the transmission-side contact portion is disposed at a position where it is pressed from the operation-side contact portion in the pressing direction.

According to this example, the light guiding part having the reflective surface is provided at a location different from the transmission-side contact portion and the operation-side contact portion transmitting an operating force, and therefore, the transmitting member can be efficiently irradiated due to disposing the reflective surface without interfering with a configuration necessary for the transmission of the operating force.

Also, in a switch device according to an example embodiment, the support post has a light guide surface extending along the pressing direction, and the light guide surface is disposed so as to intersect the reflective surface.

According to this example, the transmitting inner surface can be more efficiently irradiated due to reflecting the scattered light around the reflective surface to the reflective surface or the transmitting inner surface by the light guide surface.

Additionally, in a switch device according to an example embodiment, the force transmission member includes a plurality of the support posts, and the reflective surface is disposed between one support post and the other support post.

According to this example, the reflective surface is supported by two support posts from both sides, and therefore, it is possible to stably move the reflective surface in a well-balanced manner in the pressing direction and the release direction, and thus the reliability of an operation is high, as compared with a case of having a single support post.

Further, in the switch device according to an example embodiment, a shortest distance along the pressing direction between the reflective surface and the transmitting inner surface is shorter than a shortest distance along the pressing direction between the transmission-side contact portion and the transmitting inner surface.

According to this example, even in a case where the transmission-side contact portion and the operation-side contact portion transmitting an operating force extend over a predetermined range in the pressing direction, the reflective surface can be disposed near the transmitting inner surface, and therefore, the transmitting member can be efficiently irradiated due to disposing the reflective surface without interfering with a configuration necessary for the transmission of the operating force.

Also, in a switch device according to an example embodiment, the base part includes a stop position defining portion which comes into contact with the operation-side contact portion of the operating member moving in the pressing direction, at the pressing position.

According to this example, the operation-side contact portion plays two roles of pushing the transmission-side contact portion and restricting the movement of the operating member by coming into contact with the stop position defining portion, and therefore, as compared with a case where these two roles are realized by a plurality of constituent elements, a configuration is simplified and the quality control of forming dimensions becomes easier. Further, in order to enhance the reliability of operations relating to these two roles, it is only necessary to increase the quality of the operation-side contact portion, and therefore, the reliability of the operation of the switch device can be easily enhanced, as compared with a case where these two roles are realized by a plurality of constituent elements.

Also, in a switch device according to an example embodiment, the force transmission member is a molded body having a hollow structure.

According to this example, the force transmission member is a molded body having a hollow structure, whereby the force transmission member is hardly deformed due to shrinkage during molding, and therefore, the reflective surface can be easily molded as designed. Accordingly, the quality control of the optical decorativeness becomes easier.

Lastly, according to example embodiments of the present disclosure, it is possible to efficiently transmit light from the light source to an irradiation target portion to enhance optical decorativeness.

DETAILED DESCRIPTION OF THE DISCLOSURE

Hereinafter, a switch device according to an embodiment of the present invention will be described. The following description is intended to convey a thorough understanding of the embodiments described by providing a number of specific embodiments and details involving an switch device. It should be appreciated, however, that the present invention is not limited to these specific embodiments and details, which are exemplary only. It is further understood that one possessing ordinary skill in the art, in light of known systems and methods, would appreciate the use of the invention for its intended purposes and benefits in any number of alternative embodiments, depending on specific design and other needs.

The switch device according to the example embodiments may be disposed at, for example, a steering wheel of a vehicle and operated by the finger of a person. The switch device may be used for other uses. The switch device according to these embodiments may have an optical decorating function, and when a transparent member illuminated by an internal light source is viewed from the outside, letters and symbols are visually recognized brightly.

In this specification, an up-and-down direction, a left-and-right direction, and a front-and-back direction which are orthogonal to each other are defined. These directions are defined for convenience in order to explain the relative positional relationship and operation between constituent elements and do not limit the direction and the operation at the time of actual use of the switch device. Further, there is a case where a downward direction is referred to as a pressing direction and an upward direction is referred to as a release direction. In this specification, regardless of whether or not a word "substantially" is added to the head of a word explaining the outline of a shape, each shape is not limited to an exact geometric shape which is used for the explanation thereof.

Overall Configuration

Figure 1:
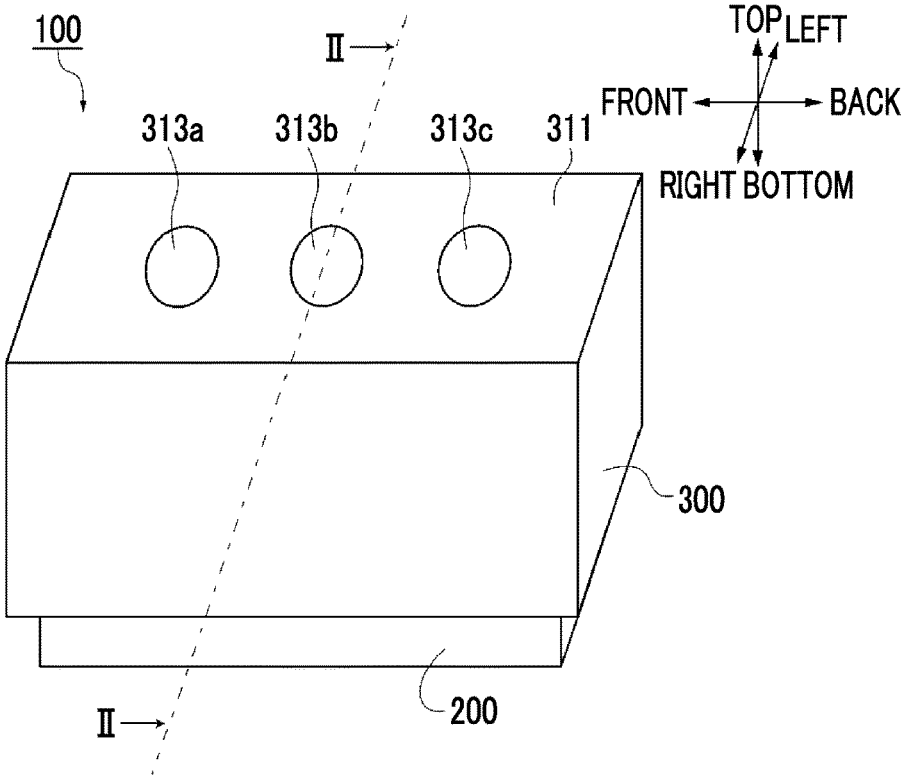
FIG. 1 is a perspective view of a switch device according to an example embodiment of the present disclosure.

FIG. 1 is a perspective view of a switch device 100. The switch device 100 may include a base part 200 and an operating member 300.

Figure 2:
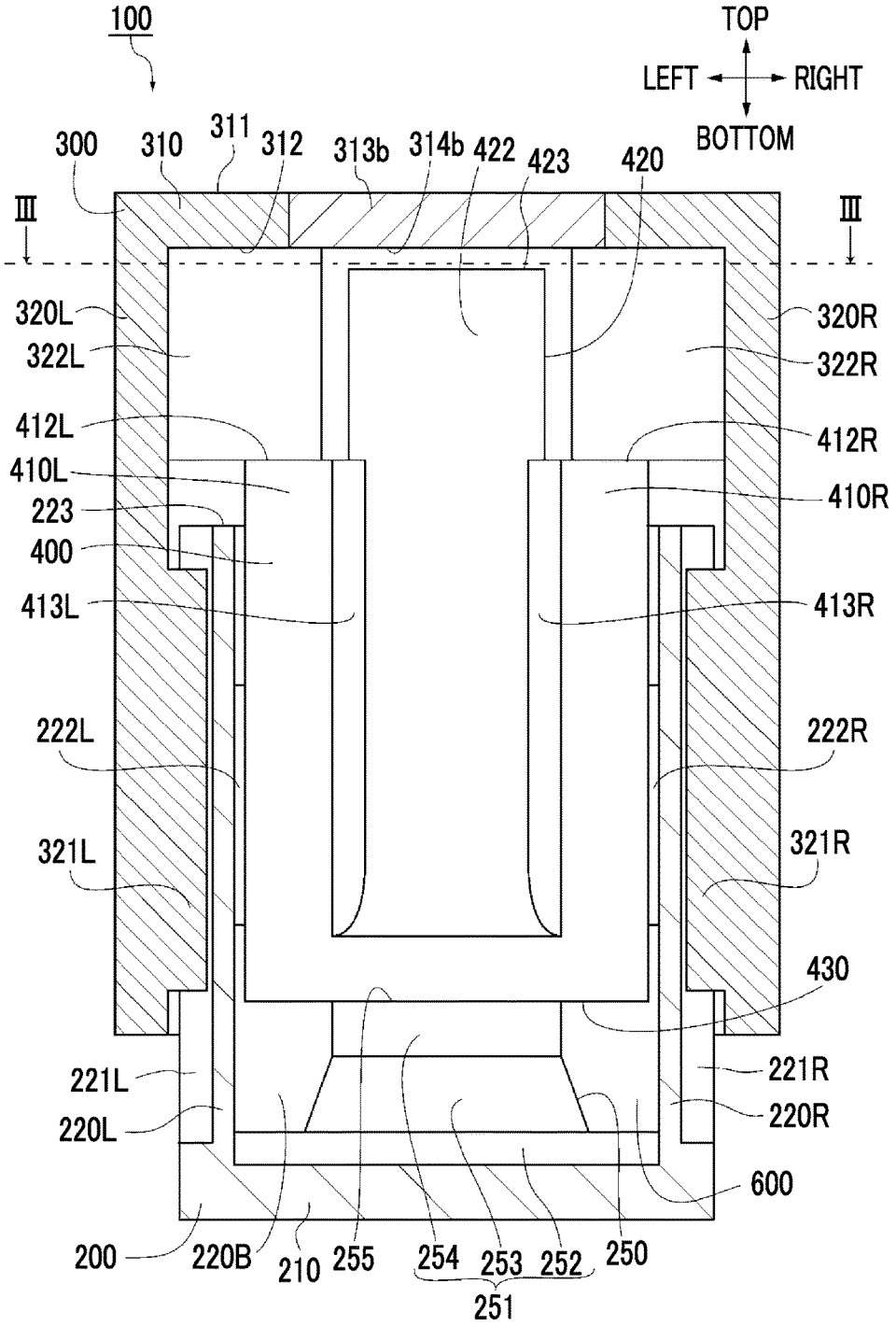
FIG. 2 is a cross-sectional view taken along line II-II of the switch device of FIG. 1.
Figure 3:
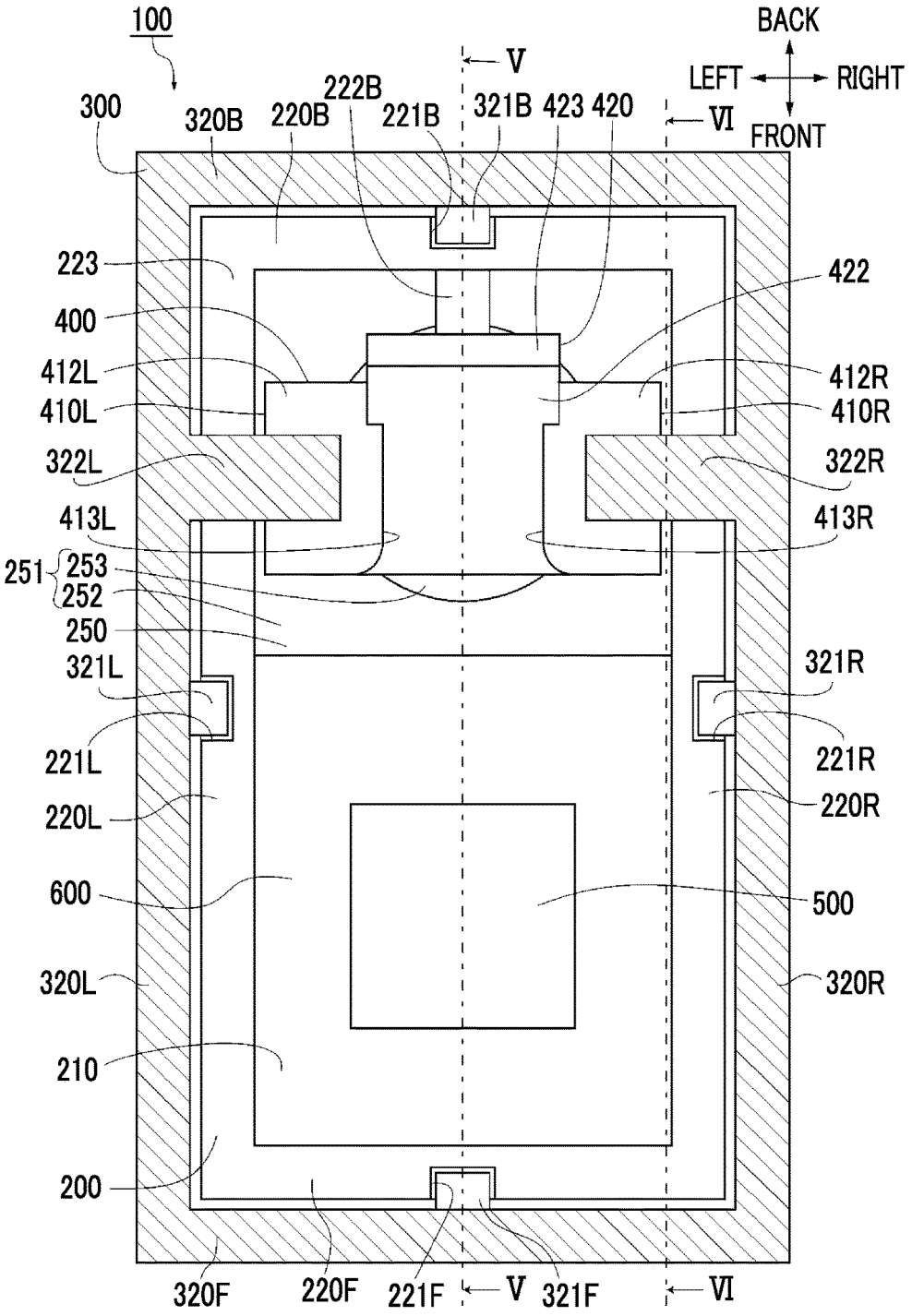
FIG. 3 is a cross-sectional view taken along line III-III of the switch device of FIG. 2.
Figure 4:
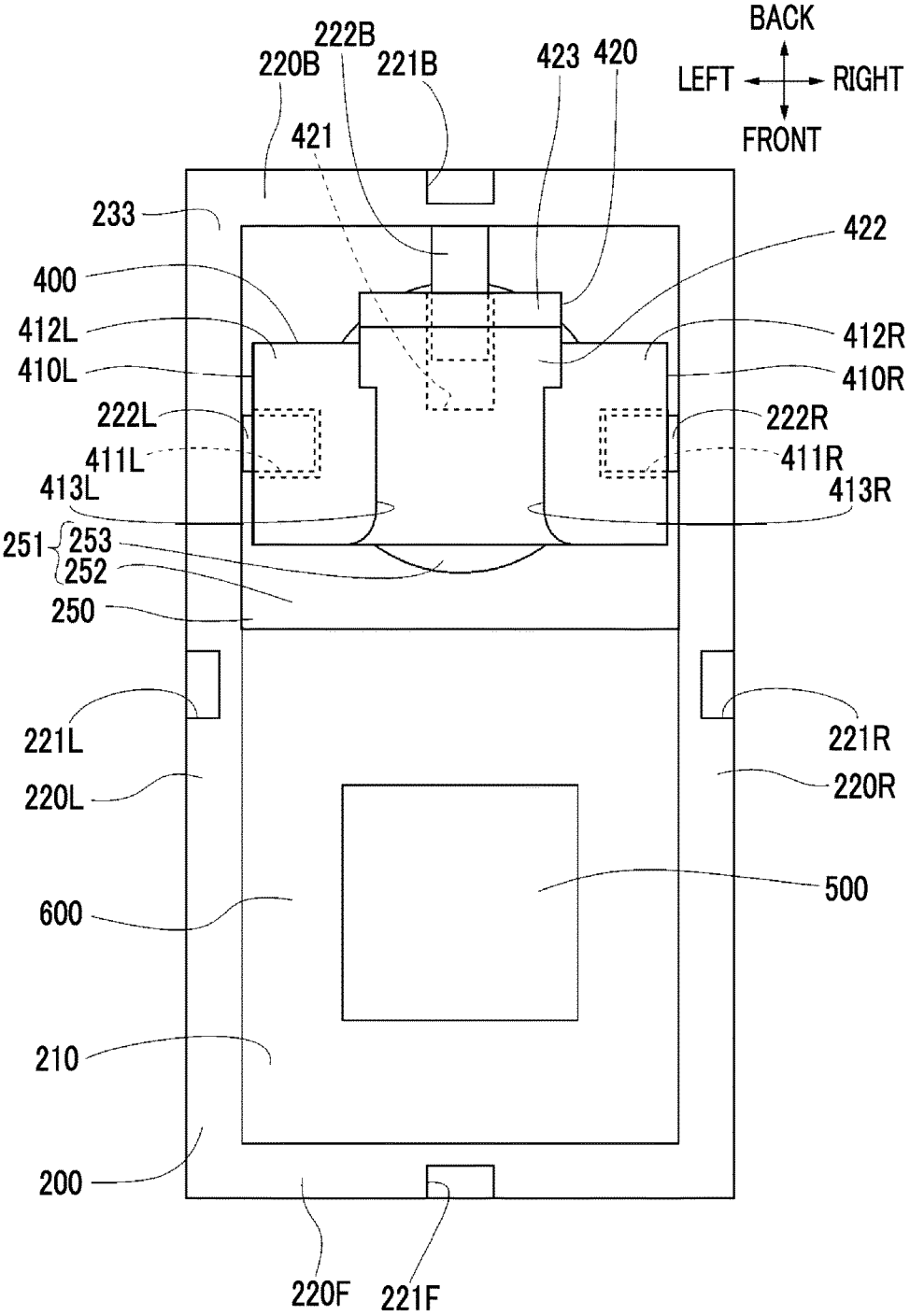
FIG. 4 is a cross-sectional view of the switch device with an operating member removed from the cross-sectional view of FIG. 3.
Figure 5:
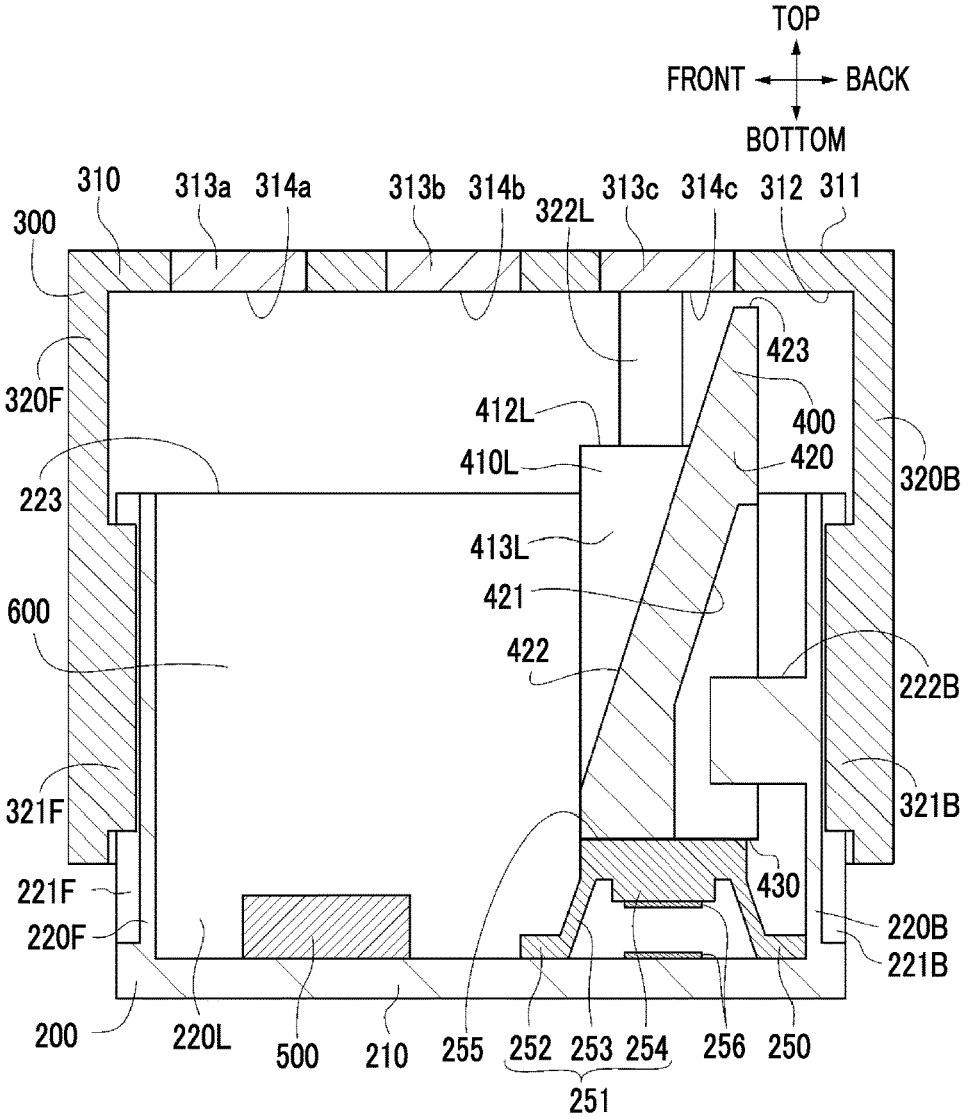
FIG. 5 is a cross-sectional view taken along line V-V of the switch device of FIG. 3.
Figure 6:
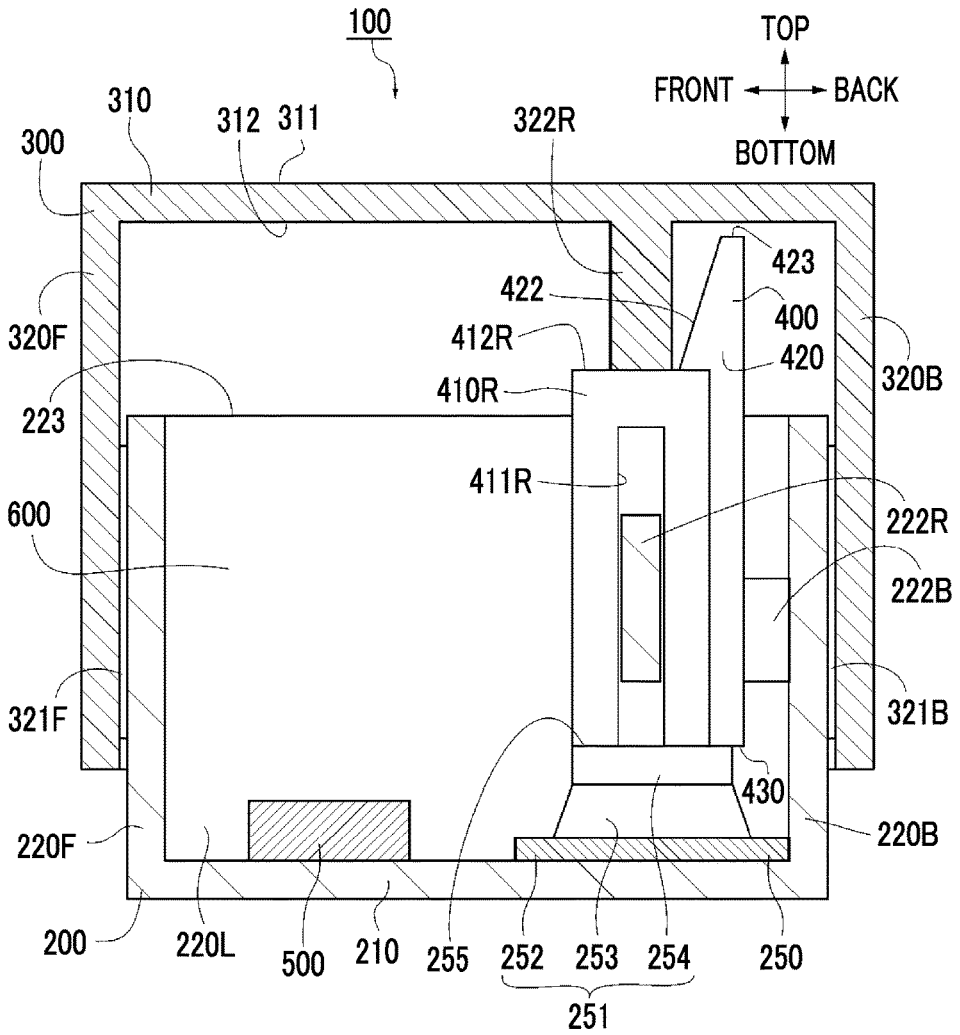
FIG. 6 is a cross-sectional view taken along line VI-VI of the switch device of FIG. 3.
Figure 7:
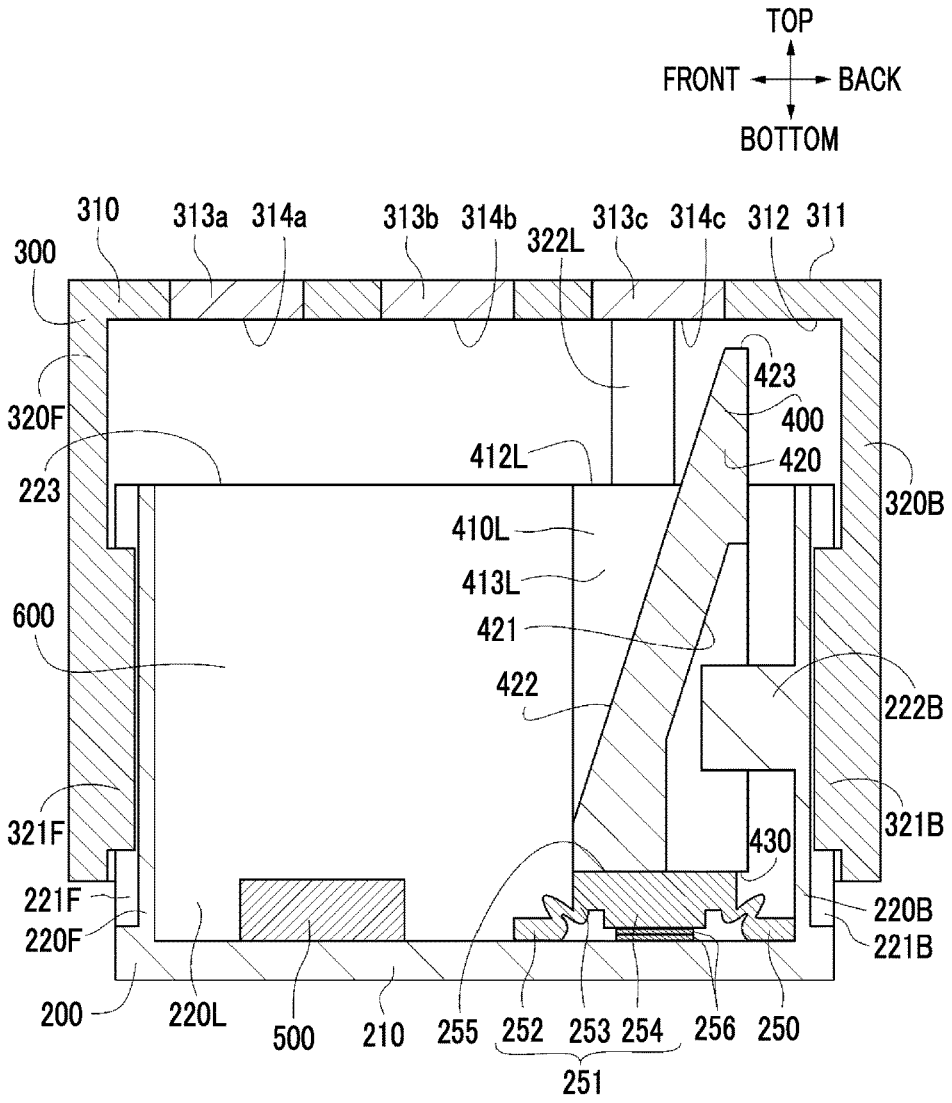
FIG. 7 is a cross-sectional view of the switch device in the same cross section as FIG. 5 when the operating member is at a pressing position.

FIG. 2 is a cross-sectional view of the switch device 100 in the cross section taken along line II-II of FIG. 1, which is orthogonal to the front-and-back direction. FIG. 3 is a cross-sectional view in the cross section taken along line III-III of FIG. 2, which is orthogonal to the up-and-down direction. FIG. 4 is a cross-sectional view of the switch device 100 in the same plane as FIG. 3, and in which the operating member 300 is omitted. FIG. 5 is a cross-sectional view in the cross section taken along line V-V of FIG. 3, which is orthogonal to the left-and-right direction, and in which the operating member 300 is at a release position. FIG. 6 is a cross-sectional view in the cross section taken along line VI-VI of FIG. 3, which is orthogonal to the left-and-right direction. FIG. 7 is a cross-sectional view of the switch device 100 in the same plane as FIG. 5, and in which the operating member 300 is at a pressing position.

Figure 9:
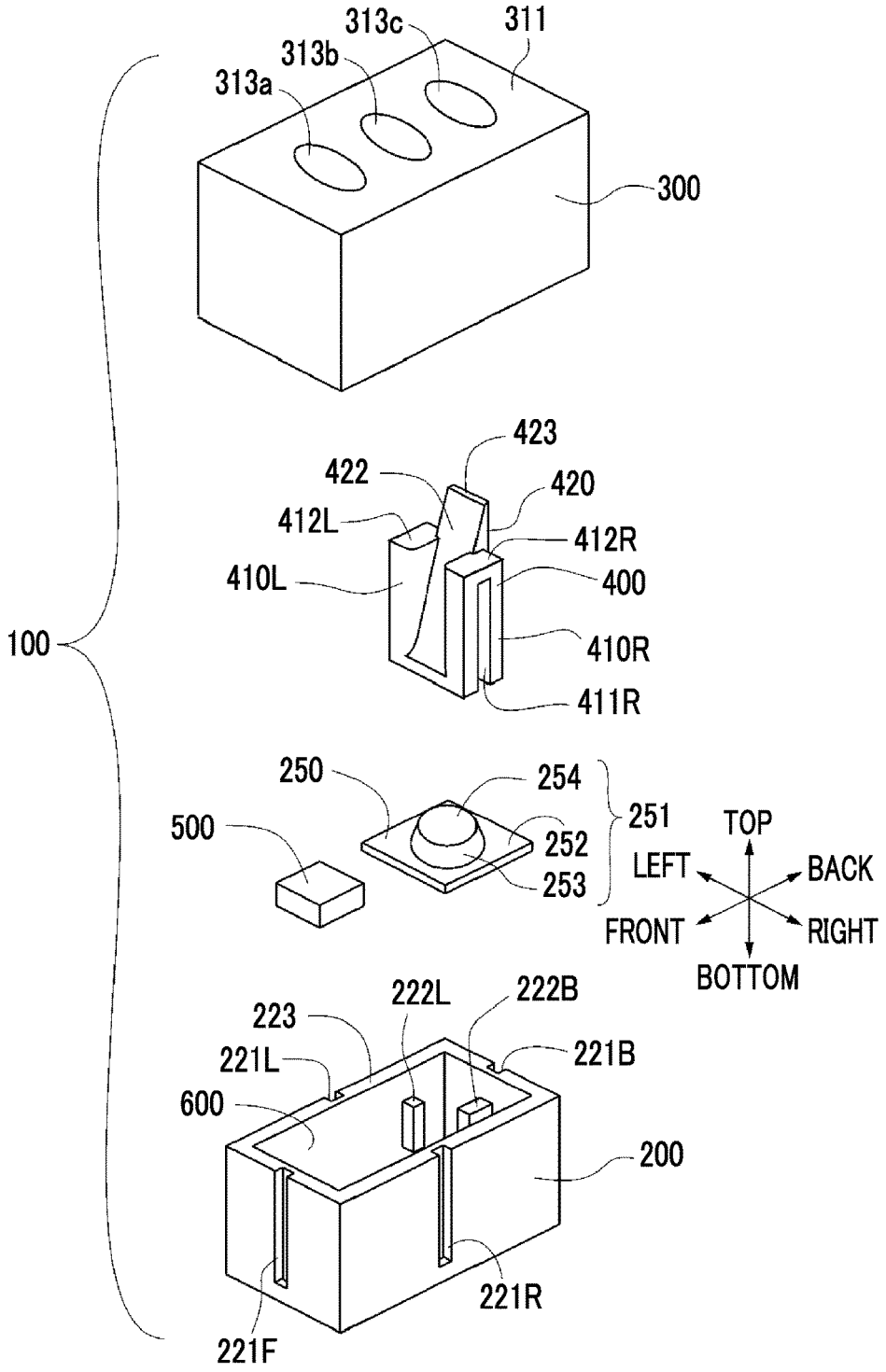
FIG. 9 is an exploded perspective view of the switch device according to an example embodiment of the present disclosure.
Figure 10:
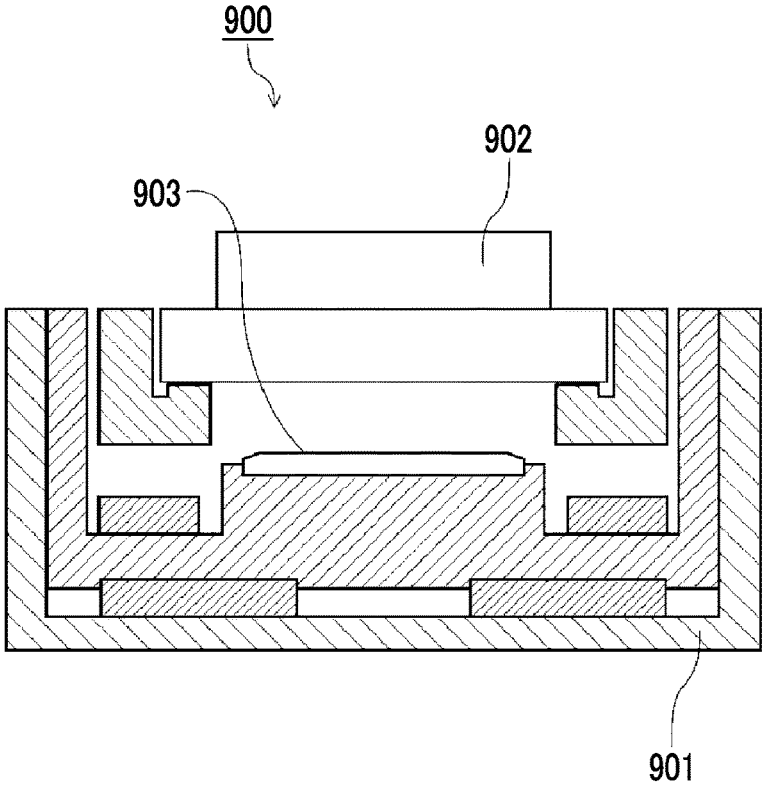
FIG. 10 is a cross-sectional view of a push button switch of the related art.
Figure 11:
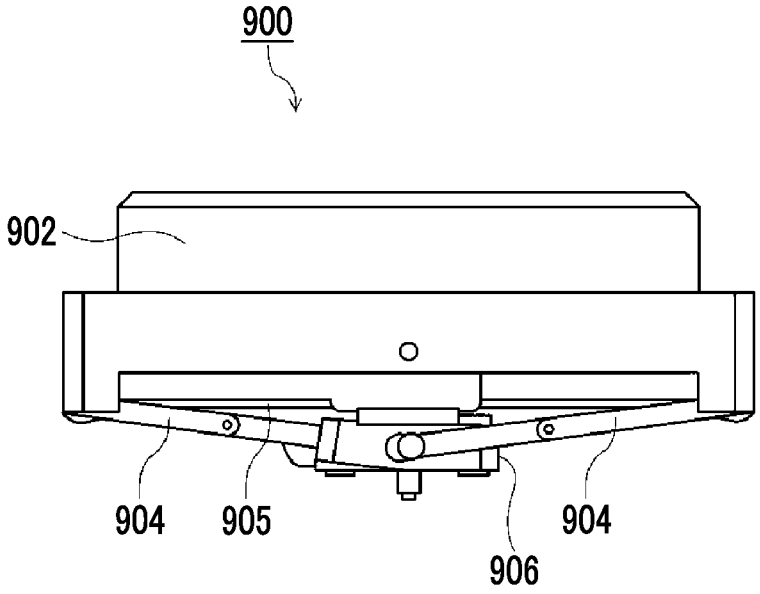
FIG. 11 is a partial side view of the push button switch of FIG. 10.

As shown in the exploded perspective view of FIG. 9, the switch device 100 may further include a force transmission member 400 and a light source 500 disposed inside of the base part 200 and the operating member 300.

Base Part

The base part 200 may have a substantially rectangular parallelepiped-shaped outer shape, as shown in FIG. 1, and is hollow and is open in the upward direction, as shown in FIG. 2. The base part 200 may include a substantially rectangular bottom plate 210 along a plane orthogonal to the up-and-down direction. Further, the base part 200 may include a front support plate 220F (FIG. 5), a back support plate 220B (FIG. 5), a left support plate 220L (FIG. 2), and a right support plate 220R (FIG. 2) (hereinafter, they are sometimes referred to as a support plate 220 without distinction) provided to extend in the upward direction from four sides of the bottom plate 210.

As shown in FIG. 5, the front support plate 220F may have a front operation guide groove 221F which may open in a forward direction and the upward direction and may be provided to extend in the downward direction from an upper end. The back support plate 220B may have a back operation guide groove 221B which may open in a backward direction and the upward direction and may be provided to extend in the downward direction from an upper end. As shown in FIG. 2, the left support plate 220L may have a left operation guide groove 221L which may be open in a leftward direction and the upward direction and may be provided to extend in the downward direction from an upper end. The right support plate 220R may have a right operation guide groove 221R which may open in a rightward direction and the upward direction and may be provided to extend in the downward direction from an upper end.

As shown in FIG. 4, the left support plate 220L may have a left inner projection 222L elongated in the up-and-down direction and may be provided to protrude in the rightward direction from an inner surface. The right support plate 220R may have a right inner projection 222R elongated in the up-and-down direction and may be provided to protrude in the leftward direction from an inner surface. The back support plate 220B may have a back inner projection 222B elongated in the up-and-down direction and provided to protrude in the forward direction from an inner surface.

As shown in FIG. 2, the base part 200 may include a stop position defining portion 223 at the upper end of the support plate 220. As shown in FIG. 3, the stop position defining portion 223 may be a frame-shaped portion extending along the upper end of the support plate 220. As shown in FIG. 7, the stop position defining portion 223 may be disposed at a position where it comes into contact with an operation-side contact portion 322 (described later) of the operating member 300 moving in the pressing direction, at the pressing position.

As shown in FIG. 2, the base part 200 may include a switch element 250 switchable between a pressed state (FIG. 7) and a released state (FIG. 5). The switch element 250 may include an elastic member 251 elastically deformable in response to an operating force that it receives from the operating member 300 (described later) through the force transmission member 400, and an electrically conductive terminal pair 256.

As shown in FIG. 5, the elastic member 251 may be disposed nearer the back side on the upper surface of the bottom plate 210. The elastic member 251 may include a fixed portion 252, a foot portion 253, and a movable portion 254. The fixed portion 252 may have a plate shape and may be disposed along the upper surface of the bottom plate 210. A hole penetrating in the up-and-down direction may be provided in a part of the fixed portion 252, and the foot portion 253 having a hollow truncated cone shape may be provided to extend in the upward direction from the circumference of the hole. The movable portion 254 may have a cylindrical shape and may be disposed at an upper end of the foot portion 253. The movable portion 254 may have an element top surface 255 facing in the upward direction and orthogonal to the up-and-down direction. In an internal space of the foot portion 253, the terminal on one side of the terminal pair 256 may be fixed to the movable portion 254 and the terminal on the other side of the terminal pair 256 may be fixed to the bottom plate 210.

The released state means a state where the operating force in the pressing direction (the downward direction), which is applied to the element top surface 255, is smaller than a predetermined magnitude and the terminal pair 256 is separated from each other, as shown in FIG. 5. The pressed state means a state where the operating force in the pressing direction (the downward direction), which is applied to the element top surface 255, is greater than or equal to the predetermined magnitude and the terminal pair 256 is in contact with each other, as shown in FIG. 7. The switch element 250 switches its output according to whether the terminal pair 256 is in contact with each other or is separated from each other. The output of the switch element 250 is transmitted to a desired device by a circuit (not shown). The switch element 250 may have other configurations capable of taking the released state and the pressed state.

The elastic member 251 may be configured so as to elastically bias the operating member 300 in the release direction through the force transmission member 400 by an elastic force which returns the operating member 300 to the release position (FIG. 5) when the operating force in the pressing direction (the downward direction), which is applied to the element top surface 255, may be smaller than the predetermined magnitude.

Light Source

The light source 500 may be disposed on the upper surface of the bottom plate 210. The light source 500 may radiate light mainly in the upward direction. The light source 500 may be disposed further toward the front side than is the switch element 250. That is, the light source 500 and the switch element 250 do not overlap each other in the up-and-down direction.

Operating Member

The operating member 300 may have a substantially rectangular parallelepiped-shaped outer shape, as shown in FIG. 1, and may be hollow and open in the downward direction, as shown in FIG. 2. The operating member 300 may include a substantially rectangular top plate 310 along a plane orthogonal to the up-and-down direction. Further, the operating member 300 may include a front plate 320F (FIG. 5), a back plate 320B (FIG. 5), a left plate 320L (FIG. 2), and a right plate 320R (FIG. 2) provided to extend in the downward direction from four sides of the top plate 310.

As shown in FIG. 5, the front plate 320F may have a front operating projection 321F elongated in the up-and-down direction and provided to protrude in the backward direction from an inner surface. The back plate 320B may have a back operating projection 321B elongated in the up-and-down direction and provided to protrude in the forward direction from an inner surface. As shown in FIG. 2, the left plate 320L may have a left operating projection 321L elongated in the up-and-down direction and provided to protrude in the rightward direction from an inner surface. The right plate 320R may have a right operating projection 321R elongated in the up-and-down direction and provided to protrude in the leftward direction from an inner surface.

As shown in FIG. 1, the operating member 300 may be disposed so as to cover the base part 200 from above. As shown in FIG. 2, an internal space 600 having a substantially rectangular parallelepiped shape may be defined between the base part 200 and the operating member 300.

As shown in FIG. 3, the front operating projection 321F may be disposed so as to slide up and down in the front operation guide groove 221F. The back operating projection 321B may be disposed so as to slide up and down in the back operation guide groove 221B. The left operating projection 321L may be disposed so as to slide up and down in the left operation guide groove 221L. The right operating projection 321R may be disposed so as to slide up and down in the right operation guide groove 221R.

As shown in FIG. 3, the movements of the front operating projection 321F, the back operating projection 321B, the left operating projection 321L, and the right operating projection 321R of the operating member 300 may be respectively restricted generally in the up-and-down direction by the front operation guide groove 221F, the back operation guide groove 221B, the left operation guide groove 221L, and the right operation guide groove 221R of the base part 200. Accordingly, the operating member 300 moves relative to the base part 200 in a predetermined range along generally the up-and-down direction.

The operating member 300 may be disposed so as to be movable in the pressing direction (the downward direction) and the release direction (the upward direction) between the pressing position (FIG. 7) causing the pressed state of the switch element 250 and the release position (FIG. 5) causing the released state of the switch element 250. The pressing direction (the downward direction) is a direction toward the pressing position (FIG. 7) from the release position (FIG. 5). The release direction (the upward direction) is a direction toward the release position (FIG. 5) from the pressing position (FIG. 7).

As shown in FIG. 2, the top plate 310 of the operating member 300 may have an operating outer surface 311 facing in the upward direction. The operating outer surface 311 may receive the operating force in the pressing direction (the downward direction) from the finger on the outside. The operating force may be given by an external object such as the finger of a person. The top plate 310 further has an operating inner surface 312 which is irradiated with light from the light source 500 in the internal space 600. The operating inner surface 312 may be disposed so as to face in the downward direction.

As shown in FIG. 5, the top plate 310 may further include a first transmitting member 313*a*, a second transmitting member 313*b*, and a third transmitting member 313*c* (hereinafter, the first transmitting member 313*a*, second transmitting member 313*b*, and third transmitting member 313*c* are sometimes referred to as a transmitting member 313 without distinction). The transmitting member 313 may transmit light between the operating outer surface 311 and the operating inner surface 312. The transmitting member 313 represents, for example, some kind of letter or figure on the operating outer surface 311 side. The appearance of the transmitting member 313 is not limited to the number and the shape shown in FIG. 1.

The first transmitting member 313*a* may have a first transmitting inner surface 314*a* facing the internal space 600 in the pressing direction. The second transmitting member 313*b* may have a second transmitting inner surface 314*b* facing the internal space 600 in the pressing direction. The third transmitting member 313*c* may have a third transmitting inner surface 314*c* facing the internal space 600 in the pressing direction. Each of the first transmitting inner surface 314*a*, the second transmitting inner surface 314*b*, and the third transmitting inner surface 314*c* (hereinafter, they are sometimes referred to as a transmitting inner surface 314 without distinction) configures a part of the operating inner surface 312 of the top plate 310. The first transmitting inner surface 314*a*, the second transmitting inner surface 314*b*, and the third transmitting inner surface 314*c* may be disposed in order from the front to the back.

When the light source 500 may be irradiating the internal space 600 with light, the transmitting inner surface 314 is irradiated. The light irradiated to the transmitting inner surface 314 may be transmitted to the operating outer surface 311 through the transmitting member 313, and therefore, when viewed from the outside, letters or figures appear to shine on the operating outer surface 311.

As shown in FIG. 2, the operating member 300 may include a left operation-side contact portion 322L and a right operation-side contact portion 322R (hereinafter, they are sometimes referred to as an operation-side contact portion 322 without distinction). Each of the operation-side contact portions 322 may be disposed above the switch element 250 in the internal space 600 and disposed at a position overlapping with a part of the switch element 250 in the up-and-down direction, as shown in FIG. 3.

As shown in FIG. 2, the left operation-side contact portion 322L may be configured integrally with the left support plate 220L and the top plate 310. The left operation-side contact portion 322L may extend in the downward direction along the left support plate 220L from the vicinity of a left end of the top plate 310. The right operation-side contact portion 322R may be configured integrally with the right support plate 220R and the top plate 310. The right operation-side contact portion 322R may extend in the downward direction along the right support plate 220R from the vicinity of a right end of the top plate 310.

When the operating member 300 is at the release position, as shown in FIG. 5, a lower end of the operation-side contact portion 322 may be located above the stop position defining portion 223 of the base part 200. When the operating member 300 is at the pressing position, as shown in FIG. 7, the lower end of the operation-side contact portion 322 may be in contact with the stop position defining portion 223 of the base part 200. That is, the operating member 300 may be prevented from moving in the downward direction beyond the pressing position, due to the contact of the operation-side contact portion 322 with the stop position defining portion 223.

Force Transmission Member

As shown in FIG. 2, the force transmission member 400 may be disposed so as to be movable in the pressing direction (the downward direction) and the release direction (the upward direction) between the switch element 250 and the operating member 300 in the internal space 600 defined between the base part 200 and the operating member 300. Further, the force transmission member 400 may come into contact with the switch element 250 and the operating member 300, thereby transmitting a force between the switch element 250 and the operating member 300. At least a portion of the force transmission member 400 may be disposed between the transmitting inner surface 314 and the switch element 250 along the pressing direction.

The force transmission member 400 may include a left support post 410L and a right support post 410R (hereinafter, they are sometimes referred to as a support post 410 without distinction) which move integrally with each other, and further includes a light guiding part 420. The force transmission member 400 may have a symmetrical shape on the right and left.

Figure 8:
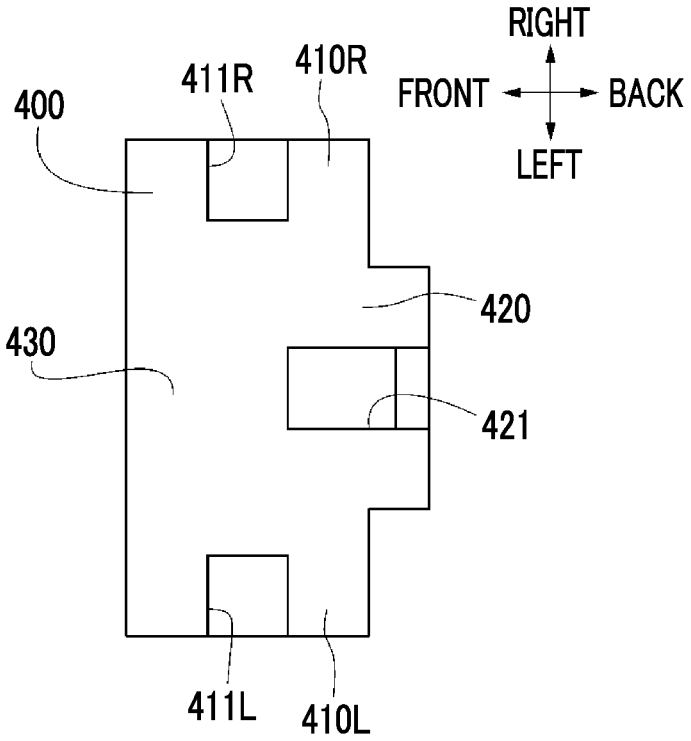
FIG. 8 is a bottom view of a force transmission member of FIG. 1.

As shown in FIG. 2, each of the support posts 410 may be a substantially rectangular parallelepiped columnar member. The number of support posts 410 may be one or may be plural. As shown in FIG. 6, the right support post 410R may have a right transmission guide groove 411R which is provided to extend long in the up-and-down direction and is open in the rightward direction and the downward direction. FIG. 8 is a bottom view of the force transmission member 400 when viewed from the bottom to the top. The left support post 410L may have a left transmission guide groove 411L which is provided to extend long in the up-and-down direction and is open in the leftward direction and the downward direction. The left transmission guide groove 411L and the right transmission guide groove 411R (hereinafter, they are sometimes referred to as a transmission guide groove 411 without distinction) may be disposed symmetrically to each other on the right and left.

As shown in FIG. 4, the left inner projection 222L of the base part 200 may be disposed in the left transmission guide groove 411L. The right inner projection 222R of the base part 200 may be disposed in the right transmission guide groove 411R.

As shown in FIG. 3, the left support post 410L may have a left transmission-side contact portion 412L. The left transmission-side contact portion 412L may be the upper end face of the left support post 410L and may be disposed at a position where it is pressed in the pressing direction (the downward direction) from the left operation-side contact portion 322L. The right support post 410R may have a right transmission-side contact portion 412R. The right transmission-side contact portion 412R is the upper end face of the right support post 410R and is disposed at a position where it is pressed in the pressing direction (the downward direction) from the right operation-side contact portion 322R. Hereinafter, the left transmission-side contact portion 412L and the right transmission-side contact portion 412R are sometimes referred to as a transmission-side contact portion 412 without distinction.

As shown in FIG. 2, the light guiding part 420 may be disposed between the left support post 410L and the right support post 410R. The lower ends of the light guiding part 420, the left support post 410L, and the right support post 410R integrally configure a transmission lower surface 430 facing in the downward direction. As shown in FIG. 5, the transmission lower surface 430 comes into contact with the element top surface 255 of the switch element 250 from above.

As shown in FIG. 5, the cross section along a plane orthogonal to the left-and-right direction, of the light guiding part 420, has a substantially triangular shape and is substantially the same at any position in the left-and-right direction. The light guiding part 420 may have a back transmission guide groove 421 which is provided to extend long in the up-and-down direction and is open in the backward direction and the downward direction. The back inner projection 222B of the base part 200 may be disposed in the back transmission guide groove 421.

As shown in FIG. 5, the light guiding part 420 may include a reflective surface 422. The reflective surface 422 may be disposed between the left support post 410L and the right support post 410R. The reflective surface 422 is a plane which is obtained by rotating a plane orthogonal to the front-and-back direction with the left-and-right direction as an axis. That is, the reflective surface 422 may be inclined from the release direction (the up-and-down direction) so as to obliquely face the transmitting inner surface 314 in the release direction (the upward direction). In another example, the reflective surface 422 may be surfaces other than the plane. The upper end of the light guiding part 420 may be located further toward the back side than is the lower end of the light guiding part 420. At least a portion of the reflective surface 422 is disposed so as to overlap the transmitting inner surface 314 in the release direction (the up-and-down direction).

The reflective surface 422 may be disposed at a position where it reflects at least a part of the light from the light source 500 to at least a portion of the transmitting inner surface 314. The reflective surface 422 may directly reflect the light from the light source 500 or may reflect scattered light diffused to the internal space 600. Since the reflective surface 422 exists, at least a part of the light which directly reaches the reflective surface 422 from the light source 500 and the light which is reflected in the internal space 600 and indirectly reaches the reflective surface 422 easily reaches the third transmitting inner surface 314*c*.

As shown in FIG. 5, the left support post 410L may have a left light guide surface 413L along a plane orthogonal to the left-and-right direction. As shown in FIG. 2, the right support post 410R has a right light guide surface 413R along a plane orthogonal to the left-and-right direction. The left light guide surface 413L and the right light guide surface 413R (hereinafter, they are sometimes referred to as a light guide surface 413 without distinction) are disposed to face each other in a symmetric manner on the right and left. The light guide surface 413 may extend along the pressing direction and is disposed so as to intersect the reflective surface 422. Since the light guide surface 413 exists, light is more easily collected to the reflective surface 422, as compared with a case where there is no light guide surface 413.

The shortest distance along the pressing direction (the up-and-down direction) between the reflective surface 422 and the transmitting inner surface 314 is shorter than the shortest distance along the pressing direction (the up-and-down direction) between the transmission-side contact portion 412 and the transmitting inner surface 314. That is, an uppermost end 423 of the light guiding part 420 connected to the reflective surface 422 is located above the transmission-side contact portion 412. It is preferable that the gap between the uppermost end 423 and the transmitting inner surface 314 is as small as possible. The smaller the gap, the more the amount of light leaking to the back is reduced, and thus the light from the light source 500 efficiently illuminates the transmitting inner surface 314.

The force transmission member 400 may be a molded body having a hollow structure in that it includes the left transmission guide groove 411L, the right transmission guide groove 411R, and the back transmission guide groove 421. The movements of the left inner projection 222L, the right inner projection 222R, and the back inner projection 222B of the base part 200 may be respectively restricted generally in the up-and-down direction by the left transmission guide groove 411L, the right transmission guide groove 411R, and the back transmission guide groove 421 of the force transmission member 400. Accordingly, the force transmission member 400 moves relative to the base part 200 in a predetermined range along generally the up-and-down direction.

The force transmission member 400 may be formed by injection molding using, for example, white resin as a material. The reflective surface 422 may be mirror-finished.

Operation

First, a case where the operating member 300 is at the release position will be described with reference to FIG. 5. The lower end of the operation-side contact portion 322 may be located above the stop position defining portion 223 of the base part 200. The operation-side contact portion 322 may be in contact with the transmission-side contact portion 412 or may be located above the transmission-side contact portion 412. The force transmission member 400 rests on the element top surface 255 of the switch element 250. Since the operating force in the downward direction is not applied to the elastic member 251, the switch element 250 may be in the released state.

If the operating outer surface 311 may be pressed with the finger in the pressing direction (the downward direction), the operating member 300 moves in the pressing direction (the downward direction) toward the pressing position shown in FIG. 7 from the release position shown in FIG. 5. After the lower end of the operation-side contact portion 322 comes into contact with the stop position defining portion 223 of the base part 200, the operating member 300 does not move in the downward direction beyond the pressing position.

A case where the operating member 300 is at the pressing position will be described with reference to FIG. 7. The operation-side contact portion 322 may be in contact with the transmission-side contact portion 412. Since a downward operating force greater than or equal to a predetermined magnitude is applied to the elastic member 251 through the force transmission member 400, the switch element 250 is in a compressed state. If the operating force becomes smaller than the predetermined magnitude, the operating member 300 returns back to the release position of FIG. 5.

According to this example, the reflective surface 422 exists, and therefore, even if the light source 500 and the transmitting member 313 are not disposed to overlap each other in the pressing direction, the transmitting member 313 can be efficiently illuminated with the light from the light source 500. Therefore, even in a case where a restriction is imposed on the position from the light source 500, the optical decorativeness can be enhanced, and thus the degree of freedom of design increases.

According to this example, since the reflective surface 422 is inclined from the release direction so as to face the transmitting inner surface 314 in the release direction (the upward direction) and at least a portion of the reflective surface 422 is disposed so as to overlap the transmitting inner surface 314 in the release direction (the upward direction), the transmitting inner surface 314 is easily irradiated with the light from the light source 500.

According to this example, the force transmission member 400 may include the reflective surface 422, and therefore, light may be efficiently transmitted to even a location where there is a concern that light may not easily reach it due to light being blocked by the force transmission member 400, if there is no reflective surface 422. Therefore, the transmitting member 313 can be irradiated with the light. Furthermore, a configuration is made such that the force transmission member can be disposed in the vicinity of the center of gravity of the switch device when viewed in a planar view, and therefore, it becomes easy to enhance the reliability of a switch operation of the switch device.

According to this example, the light guiding part 420 having the reflective surface 422 may be provided at a location different from the transmission-side contact portion 412 and the operation-side contact portion 322 transmitting the operating force, and therefore, the transmitting member 313 can be efficiently irradiated due to disposing the reflective surface 422 without interfering with a configuration necessary for the transmission of the operating force.

According to this example, the transmitting inner surface 314 can be more efficiently irradiated due to reflecting the scattered light around the reflective surface 422 to the reflective surface 422 or the transmitting inner surface 314 by the light guide surface 413.

According to this example, the reflective surface 422 may be supported by the two support posts 410 from both sides, and therefore, it may be possible to stably move the reflective surface 422 in a well-balanced manner in the pressing direction and the release direction, and thus the reliability of an operation is high, as compared with a case of having a single support post 410.

According to this example, even in a case where the transmission-side contact portion 412 and the operation-side contact portion 322 transmitting the operating force extend over a predetermined range in the pressing direction, the reflective surface 422 can be disposed near the transmitting inner surface 314, and therefore, the transmitting member 313 can be efficiently irradiated due to disposing the reflective surface 422 without interfering with a configuration necessary for the transmission of the operating force.

According to this example, the operation-side contact portion 322 plays two roles of pushing the transmission-side contact portion 412 and restricting the movement of the operating member 300 by coming into contact with the stop position defining portion 223, and therefore, a configuration is simplified, as compared with a case where these two roles are realized by a plurality of constituent elements. Further, in order to enhance the reliability of operations relating to these two roles, it is only necessary to increase the quality of the operation-side contact portion 322, and therefore, the reliability of the operation of the switch device 100 can be easily enhanced, as compared with a case where these two roles are realized by a plurality of constituent elements.

According to this example, the force transmission member 400 may be a molded body having a hollow structure, whereby the force transmission member 400 is hardly deformed due to shrinkage during molding, and therefore, the force transmission member 400 which includes the reflective surface 422 can be easily molded as designed. In this way, the quality control of the optical decorativeness of the switch device 100 becomes easier.

In an example embodiment, it the switch element 250 and the force transmission member 400 may be disposed in the vicinity of the center of gravity of the operating member 300 when viewed from the top to the bottom. According to this other example, an operating force and an elastic force are efficiently transmitted between the operating member 300, the force transmission member 400, and the switch element 250, and therefore, the reliability of the operation of the switch device 100 is high, as compared with a case where the operating member 300, the force transmission member 400, and the switch element 250 may be disposed to greatly deviate from the center of gravity. According to this example, an elastic force from the elastic member 251 is efficiently transmitted to an operator who operates the switch device 100, and therefore, an operation feeling of the switch device 100 is high. The outer shape is not limited to a rectangular parallelepiped.

The outer shape of the switch device 100 is not limited to a rectangular parallelepiped. For example, the outer shape of the switch device 100 may be a triangular shape, other polygonal shapes, a circular shape, an elliptical shape, a columnar shape that looks like another shape, when viewed from the top to the bottom, or may be other shapes.

The present invention is not limited to the embodiment described above. That is, those skilled in the art may perform various changes, combinations, sub-combinations, and substitutes with regard to the constituent components of the above-described embodiment within the technical scope or equivalent scope of the present invention.

The present invention is applicable to various switch devices in which a transmitting member is irradiated with a light source. For example, the present invention is applicable to a switch device which is mounted on a steering wheel of a transporter such as a vehicle, an aircraft, or a ship.

It should be understood by those skilled in the art that various modifications, combinations, sub-combinations and alterations may occur depending on design requirements and other factors insofar as they are within the scope of the appended claims of the equivalents thereof.

Accordingly, the embodiments of the present inventions are not to be limited in scope by the specific embodiments described herein. Further, although some of the embodiments of the present disclosure have been described herein in the context of a particular implementation in a particular environment for a particular purpose, those of ordinary skill in the art should recognize that its usefulness is not limited thereto and that the embodiments of the present inventions can be beneficially implemented in any number of environments for any number of purposes. Accordingly, the claims set forth below should be construed in view of the full breadth and spirit of the embodiments of the present inventions as disclosed herein. While the foregoing description includes many details and specificities, it is to be understood that these have been included for purposes of explanation only, and are not to be interpreted as limitations of the invention. Many modifications to the embodiments described above can be made without departing from the spirit and scope of the invention.

What is claimed is:

1. A switch device comprising:

a base part which includes a switch element switchable between a pressed state and a released state;

an operating member which is disposed so as to be movable between a pressing position causing the pressed state of the switch element and a release position causing the released state of the switch element, in a pressing direction toward the pressing position from the release position and a release direction toward the release position from the pressing position;

a force transmission member which is disposed so as to be movable in the pressing direction and the release direction between the switch element and the operating member in an internal space defined between the base part and the operating member and transmits a force between the switch element and the operating member;

a light source configured to radiate light to the internal space; and a reflective surface, wherein the operating member includes an operating outer surface configured to receive an operating force in the pressing direction from the outside, an operating inner surface configured to be irradiated with light from the light source in the internal space, and a transmitting member configured to transmit light between the operating outer surface and the operating inner surface, the transmitting member has a transmitting inner surface which faces the internal space in the pressing direction, at least a portion of the force transmission member is disposed along the pressing direction between the transmitting inner surface and the switch element, the reflective surface is included in force transmission member and is disposed at a position where the reflective surface reflects at least a part of the light from the light source to at least a portion of the transmitting inner surface, the operating member includes an operation-side contact portion which comes into contact with the force transmission member, the force transmission member includes a light guiding part and a support post which moves integrally with each other, the light guiding part has the reflective surface, the support post has a transmission-side contact portion, and the transmission-side contact portion is disposed at a position where the transmission-side contact portion is pressed from the operation-side contact portion in the pressing direction.

2. The switch device according to claim 1, wherein the reflective surface is inclined from the release direction so as to face the transmitting inner surface in the release direction, and at least a portion of the reflective surface is disposed so as to overlap the transmitting inner surface in the release direction.

3. The switch device according to claim 1, wherein the support post has a light guide surface extending along the pressing direction, and the light guide surface is disposed so as to intersect the reflective surface.

4. The switch device according to claim 1, wherein the force transmission member includes a plurality of the support posts, and the reflective surface is disposed between one support post and the other support post.

5. The switch device according to claim 1, wherein a shortest distance along the pressing direction between the reflective surface and the transmitting inner surface is shorter than a shortest distance along the pressing direction between the transmission-side contact portion and the transmitting inner surface.

6. The switch device according claim 1, wherein the base part includes a stop position defining portion which comes into contact with the operation-side contact portion of the operating member moving in the pressing direction, at the pressing position.

7. A switch device comprising:

a base part which includes a switch element switchable between a pressed state and a released state;

an operating member which is disposed so as to be movable between a pressing position causing the pressed state of the switch element and a release position causing the released state of the switch element, in a pressing direction toward the pressing position from the release position and a release direction toward the release position from the pressing position;

a force transmission member which is a molded body having a hollow structure and is disposed so as to be movable in the pressing direction and the release direction between the switch element and the operating member in an internal space defined between the base part and the operating member and transmits a force between the switch element and the operating member;

a light source configured to radiate light to the internal space; and a reflective surface, wherein the operating member includes an operating outer surface configured to receive an operating force in the pressing direction from the outside, an operating inner surface configured to be irradiated with light from the light source in the internal space, and a transmitting member configured to transmit light between the operating outer surface and the operating inner surface, the transmitting member has a transmitting inner surface which faces the internal space in the pressing direction, at least a portion of the force transmission member is disposed along the pressing direction between the transmitting inner surface and the switch element, the reflective surface is disposed at a position where the reflective surface reflects at least a part of the light from the light source to at least a portion of the transmitting inner surface, the operating member includes an operation-side contact portion which comes into contact with the force transmission member, the force transmission member includes a light guiding part and a support post which moves integrally with each other, the light guiding part has the reflective surface, the support post has a transmission-side contact portion, and the transmission-side contact portion is disposed at a position where the transmission-side contact portion is pressed from the operation-side contact portion in the pressing direction.

8. The switch device according to claim 7, wherein the reflective surface is inclined from the release direction so as to face the transmitting inner surface in the release direction, and at least a portion of the reflective surface is disposed so as to overlap the transmitting inner surface in the release direction.

9. The switch device according to claim 7, wherein the support post has a light guide surface extending along the pressing direction, and the light guide surface is disposed so as to intersect the reflective surface.

10. The switch device according to claim 7, wherein the force transmission member includes a plurality of the support posts, and the reflective surface is disposed between one support post and the other support post.

11. The switch device according to claim 7, wherein a shortest distance along the pressing direction between the reflective surface and the transmitting inner surface is shorter than a shortest distance along the pressing direction between the transmission-side contact portion and the transmitting inner surface.

12. The switch device according to claim 7, wherein the base part includes a stop position defining portion which comes into contact with the operation-side contact portion of the operating member moving in the pressing direction, at the pressing position.

* * * * *